US012529223B2

(12) United States Patent
Mckenna

(10) Patent No.: US 12,529,223 B2
(45) Date of Patent: Jan. 20, 2026

(54) ACOUSTIC MATERIAL FRAME AND METHOD

(71) Applicant: Kelly B. Mckenna, North Oaks, MN (US)

(72) Inventor: Kelly B. Mckenna, North Oaks, MN (US)

( * ) Notice: Subject to any disclaimer, the term of this patent is extended or adjusted under 35 U.S.C. 154(b) by 217 days.

(21) Appl. No.: 18/244,523

(22) Filed: Sep. 11, 2023

(65) Prior Publication Data

US 2024/0068228 A1 Feb. 29, 2024

Related U.S. Application Data

(63) Continuation-in-part of application No. 16/987,033, filed on Aug. 6, 2020, now Pat. No. 11,753,818.

(60) Provisional application No. 62/883,866, filed on Aug. 7, 2019.

(51) Int. Cl.
*E04B 1/86* (2006.01)

(52) U.S. Cl.
CPC ..... *E04B 1/86* (2013.01)

(58) Field of Classification Search
CPC .... E04B 1/8404; E04B 1/8409; E04B 1/8209; E04B 1/86; E04B 2001/8423; E04B 2001/8442; E04B 2001/8447; E04B 2001/8452; E04B 2001/8457; E04B 2001/8461; E04B 2001/8476; E04B 2001/848; E04B 2/7412; E04B 1/1906; E04B 1/1903; E04B 1/1912; E04B 2001/1915; E04B 2001/1933; E04B 2001/1966; Y10T 403/32483; Y10T 403/32475
USPC ..... 403/109.2, 109.3
See application file for complete search history.

(56) References Cited

U.S. PATENT DOCUMENTS 1,400,066 A * 12/1921 Huck ..... A63H 33/107 135/909
1,995,819 A 3/1935 Rogers
3,483,947 A 12/1969 Sulewsky
3,792,882 A * 2/1974 Varichon ..... F16B 7/00 403/171
4,016,689 A 4/1977 Wendt
4,040,212 A 8/1977 Goransson
4,258,511 A * 3/1981 Strain ..... E04H 1/1238 52/406.1
4,271,654 A 6/1981 Jungbluth
4,385,849 A * 5/1983 Crain ..... F16B 7/105 343/901
4,423,573 A 1/1984 Omholt et al.
4,574,099 A 3/1986 Nixon
4,574,538 A 3/1986 Grant
4,630,550 A * 12/1986 Weitzman ..... A47B 13/06 403/171

(Continued)

FOREIGN PATENT DOCUMENTS

EP 4549674 A1 * 5/2025 ..... E04B 1/8404

*Primary Examiner* — Kyle J. Walraed-Sullivan
(74) *Attorney, Agent, or Firm* — R. John Bartz

(57) ABSTRACT

A thermoplastic frame for holding acoustical material has extruded square plastic tubing that is inserted or snap-fit onto corner connectors and T-connectors to make an enclosure that houses and compresses the acoustic material. During assembly of the frame, the acoustic material is inserted in the open side of a secondary frame assembly and enclosed and compressed with a cap assembly snap-fit onto the secondary frame assembly.

17 Claims, 8 Drawing Sheets

(56) References Cited

U.S. PATENT DOCUMENTS 4,702,046 A 10/1987 Haugen et al.
4,706,422 A 11/1987 Ashton
4,891,920 A 1/1990 Pingston
4,929,114 A 5/1990 Young
4,964,250 A 10/1990 Nelson
4,989,688 A * 2/1991 Nelson ..... E04B 1/8227 181/291
5,020,632 A 6/1991 Nelson
5,079,890 A 1/1992 Kubik et al.
5,135,073 A 8/1992 Nelson
5,172,530 A 12/1992 Fishel et al.
5,220,765 A * 6/1993 Kubik ..... E04B 1/19 52/650.1
5,230,197 A 7/1993 Hart
5,352,057 A * 10/1994 Zody ..... F16B 7/105 403/321
5,421,666 A * 6/1995 Spears ..... F16B 7/0446 52/81.3
5,556,218 A 9/1996 Homer
6,079,894 A * 6/2000 Obitts ..... A61H 3/02 403/109.2
6,158,176 A 12/2000 Perdue
6,247,869 B1 6/2001 Lichvar
9,605,425 B1 * 3/2017 Hendry ..... E04B 1/2403
9,932,734 B1 * 4/2018 Winter ..... E04B 1/1903
10,036,156 B1 * 7/2018 Macdonald ..... E04F 13/083
10,066,384 B1 * 9/2018 Hendry ..... E06B 9/52
2002/0197106 A1 * 12/2002 Wu ..... F16B 7/042 403/329
2003/0215283 A1 * 11/2003 Hsieh ..... F16B 7/105 403/109.2
2004/0088941 A1 * 5/2004 Boots ..... A47B 47/027 52/655.1
2005/0249545 A1 * 11/2005 Tsai ..... E04H 15/50 403/109.3
2006/0002759 A1 * 1/2006 Blackman ..... F16B 7/18 403/109.3
2006/0124388 A1 6/2006 Pompei
2006/0163438 A1 * 7/2006 Wojotowicz ..... A47F 5/14 248/300
2008/0253832 A1 * 10/2008 O'Connell ..... F16B 7/105 403/109.3
2009/0095856 A1 * 4/2009 Nakatani ..... F16M 11/22 248/188.8
2012/0163879 A1 * 6/2012 Joo ..... G03G 21/186 399/111
2014/0233781 A1 8/2014 Kawakami et al.
2015/0096832 A1 4/2015 Perez et al.
2016/0222643 A1 8/2016 Castelli
2017/0044753 A1 2/2017 Bowron
2018/0075787 A1 * 3/2018 Frey ..... G09F 15/0012
2018/0094418 A1 * 4/2018 Winter ..... E04B 1/5831
2018/0238041 A1 * 8/2018 Styrc ..... E04B 1/2608
2018/0347200 A1 12/2018 Hooper
2019/0024364 A1 1/2019 Lestini et al.
2019/0093343 A1 3/2019 Dimitrakopoulos et al.
2019/0127972 A1 * 5/2019 Mackett ..... E04B 1/86
2019/0211557 A1 7/2019 Moghaddam
2020/0270861 A1 8/2020 Bartella et al.
2021/0043182 A1 * 2/2021 Moon ..... G10K 11/162
2021/0190278 A1 6/2021 Bartella et al.
2021/0381223 A1 12/2021 Webb et al.

* cited by examiner

ACOUSTIC MATERIAL FRAME AND METHOD

CROSS REFERENCE TO RELATED APPLICATION

This application is a continuation-in-part of U.S. patent application Ser. No. 16/987,033 filed Aug. 6, 2020. U.S. patent application Ser. No. 16/987,033 claims the priority of U.S. Application Ser. No. 62/883,866 filed Aug. 7, 2019.

FIELD OF THE INVENTION

The technology of the invention relates to an acoustic frame device, methods of manufacturing the device, and assembly, covering and methods of installation associated with the device.

BACKGROUND OF THE INVENTION

People that require acoustic treatment in their home or business need special material that absorbs sound, typically insulation such as fiberglass, mineral wool, open cell foam or other such types of material. Because these are raw materials and need to be framed and mounted or hung in a desired area and not behind walls, it requires users to either hire a company to custom build frames to enclose the raw material or purchase the frame materials and build the enclosures themselves. This may, depending on the user's skill level and available tools and time, take many hours with uncertain or inconsistent results.

Acoustically treating a space where people gather is challenging because commonly the acoustic materials are made mostly of compressed fiberglass insulation, mineral wool or other construction type materials. These materials need to be enclosed in a frame and covered by fabric for mounting on walls or ceilings in the desired area. Currently there is no simple, do-it-yourself (DIY) solution that does not require power tools, staple guns, tape measures, adhesives, basic construction skills, ample work space and lots of time. Currently there are no known quick and convenient (much less DIY) solutions to framing, covering and mounting acoustic material devices that control or absorb sound wave frequencies such as speech, noise, music, echo or other unwanted sounds. Most users are forced to contract with a company to build a frame to hold the acoustic material, which are expensive and many times creates a very heavy end product because the materials they use are typically either wood or metal. Acoustic frames currently being manufactured by companies use heavy materials such as wood, aluminum, steel or other metals. They require tools, time and labor to assemble the final product. Many times the frame is prohibitively heavy and requires multiple people and heavy-duty or industrial fasteners or anchors drilled into the target surface to install them. Current framing methods often cover the sides and the back of the frame, reducing air flow and therefore, sound absorption. Covering a large percentage of the sound absorption material greatly reduces the effectiveness and performance of the product. This method is also much more expensive. In seeking an alternative, the user is forced to build a frame themselves from traditional raw materials such as wood, aluminum or metal, and takes considerable time and skill. Building a frame usually includes using power tools such as skill saws, power drills, and staple guns. Some of these methods are beyond the scope of a typical user since they may not own power tools or even have access to an area to construct one such as a shop or a garage, e.g. apartments, town homes or condominiums. There are no convenient do-it-yourself (DIY) methods or kits on the market. The current alternatives fail to meet the needs of the industry because consumers want to purchase something that is convenient and easy to assemble that meets their needs. Existing attempts are similarly unable to meet the needs of the industry because they require at least some type of tools for assembly. These efforts also fail to meet the consumers' demand for a product that is DIY, yet is light weight, high performance, and can be put together quickly and easily without tools. No solution like that exists in the market today.

SUMMARY OF THE INVENTION

The acoustic material frame is a do-it-yourself plastic tube frame that encloses acoustic material. The frame is manufactured using strong but lightweight recycled extruded plastic tubing along with custom engineered corner connectors and T-connectors to allow a person to assemble an acoustic frame themselves by snap-fitting the tubing on the connectors within minutes without tools. The extruded plastic frame tubing is relatively thin to allow for maximum air flow to enhance acoustic absorption. The device also includes a custom-made fabric slipcover and simplistic mounting apparatus. The acoustic material frame is a unique DIY manufactured product made of plastic or thermoplastic, precisely measured and pre-cut and light weight and has specially designed custom connectors. The acoustic material frame is easy to assemble without the use of tools. The device is snap-fit together by taking the frame tubing and snap-fitting the tubing onto the custom designed connector trunks to complete the frame. The frame is more effective and performs better than existing solutions because there is far less material and therefore allows more air flow and sound frequencies to pass into the frame to be absorbed. The acoustic material frame has a built-in mounting method for easy installation. The acoustic material frame and associated components are ecofriendly because they are constructed and manufactured using recycled and/or biodegradable plastics or thermoplastics. The acoustic frame has a custom fit, slip-cover that covers the frame and acoustic fabric to keep the insulation fibers from escaping into the air. The slipcover is available in multiple colors to match the user's decor. The acoustic material frame is also manufactured in such a way as to apply industry standard equipment such as thermoplastic injection molding, plastic extrusion, CNC milling, 3D printing or similar or related manufacturing equipment. Similarly, the disclosed method is unique when compared with other processes and solutions in that the components are manufactured to fit together and be mounted to the target surface by the user without using common household or power tools or assistance from others and truly a DIY product. The acoustic material frame is unique in that it is structurally different from other known devices or solutions. More specifically, the acoustic material frame is unique due to it being manufactured to fit together using a unique method of assembly using recycled thermoplastic extruded tubing and custom designed corner connectors and T-connectors that snap-fit together to allow for easy assembly of the device without tools. Because of its manufactured design, the acoustic material frame is light weight, uses less plastic material and thin tubing, and is relatively porous to allow maximum amount of sound waves to flow into the frame and taken in by substantially all of the acoustic material, maximizing effectiveness. Further, the acoustic material frame is easily mounted to a targeted surface by a single person without use of common household tools. One of the most unique aspects of the device is the ease of assembly. It is designed to be assembled in a relatively short period of time using no tools. Speed, performance and ease of assembly of the device is unlike other crude, do-it-yourself assemblies requiring lumber, tools, hardware, workspace and time.

DESCRIPTION OF THE INVENTION

In the following detailed descriptions of the acoustic material frame assembly, reference is made to the accompanying drawing that form a part hereof, and in which are shown, by way of illustration, specific embodiments in which the invention may be practiced. It is to be understood that other embodiments may be utilized and structure changes may be made or other method steps and sequence thereof may be used without departing from the scope of the present invention. The acoustic material frame assembly is herein described as used in home and business environments. The frame assembly can have uses in other environments when sound absorption is desired.

Figure 1:
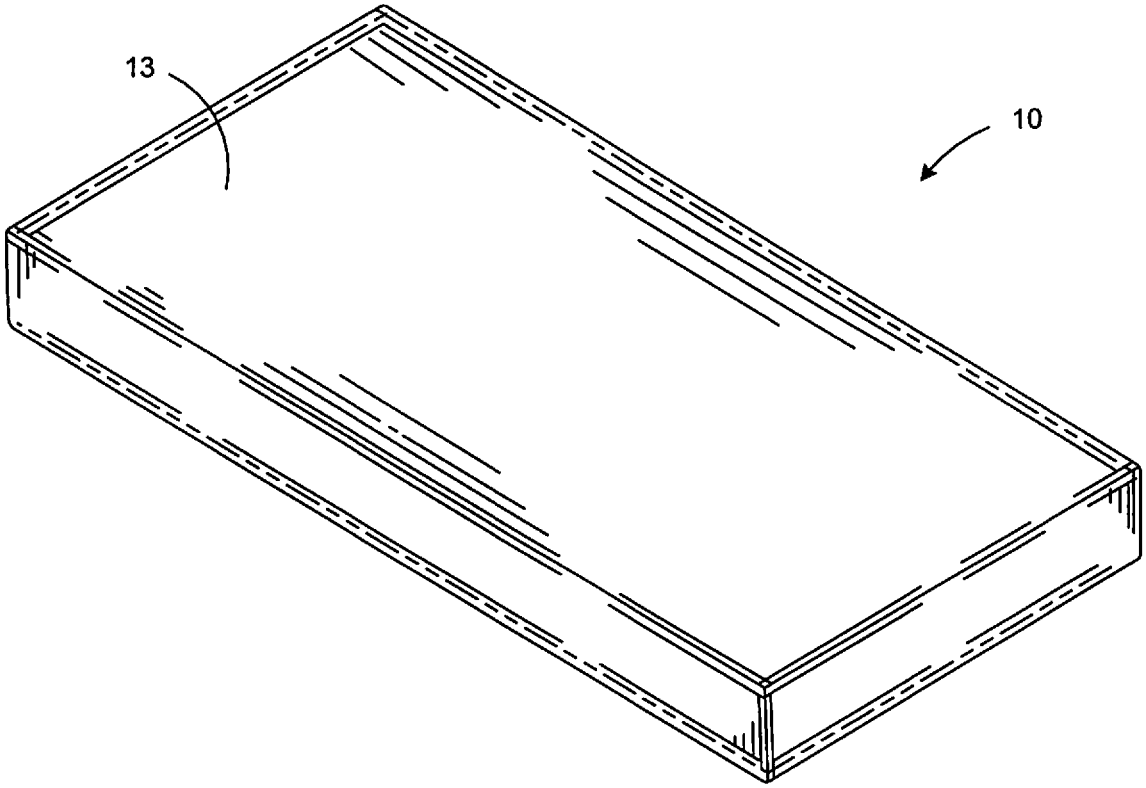
FIG. 1 is a perspective view of the acoustic material frame assembly of the invention.
Figure 2:
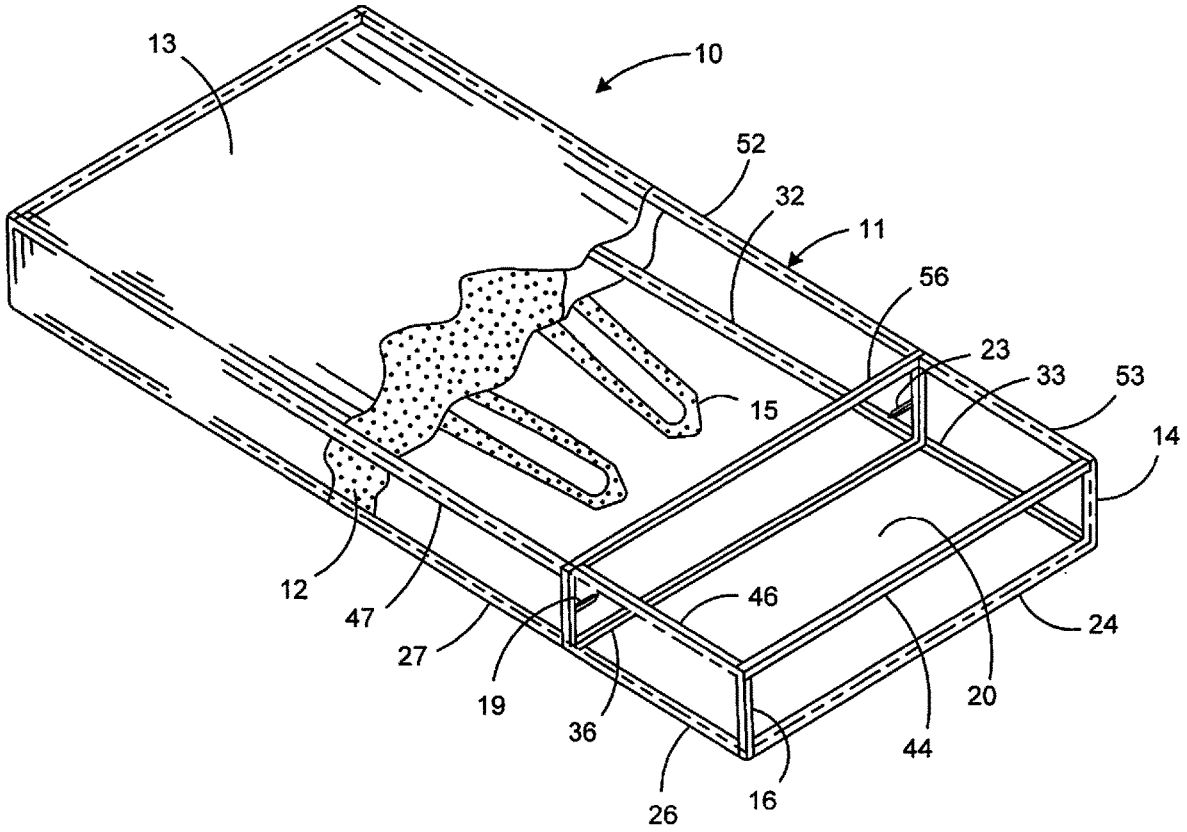
FIG. 2 is a foreshortened perspective view of the acoustic material frame assembly of FIG. 1.
Figure 3:
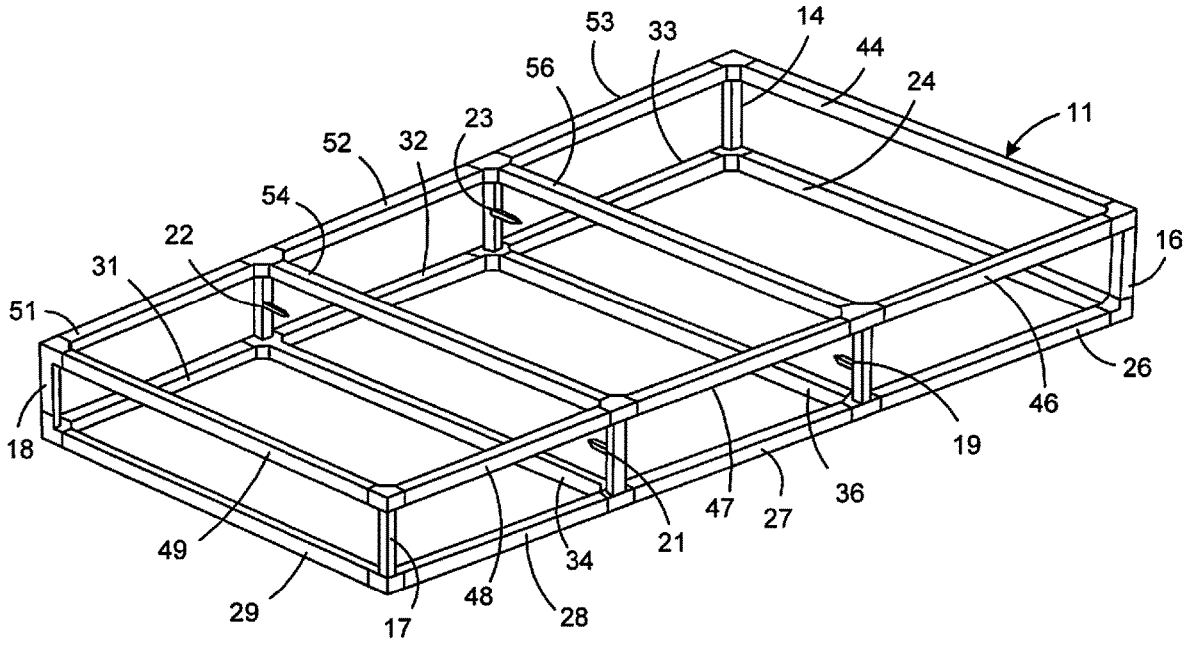
FIG. 3 is a perspective view of the frame of the acoustic material frame assembly of FIG. 1.

Referring to FIGS. 1 to 3, there is shown an acoustic material frame assembly indicated generally at 10. Frame assembly 10 is a do-it-yourself snap-fit assembly having a plastic tube frame 11 that encloses acoustic material 12. Frame 11 can be assembled very quickly without the need for power tools, saws, staple guns, tape measures, nails, screws, staples, glue, adhesive compounds or other construction materials. Frame 11 houses, holds or otherwise encloses and compresses acoustic material 12 and when covered with fabric slipcover 13 or other similar material, can be placed in an area where sound absorption is needed and used to control echo, standing waves, slap-back or other problematic sound waves from any source. Frame 11 is manufactured using a thermoplastic material such as polylactic acid (PLA), but can also be manufactured using other plastics or thermoplastics. Frame 11 can be manufactured in such a way as to apply industry standard equipment such as plastic injection molding, plastic extrusion, computer numerically controlled (CNC) milling, or additive manufacturing (AM) such as three dimensional (3D) printing or other related manufacturing equipment.

Frame 11 has four-way corner connectors 14, 16, 17 and 18 and six-way T-connectors 19, 21, 22 and 23 that are four inches in depth, thereby allowing tubing 24, 26, 27, 28, 29, 31, 32, 33, 34, 36, 44, 46, 47, 48, 49, 51, 52 and 53 to be coupled by snap-fitting or other methods onto corner connectors 14, 16, 17 and 18 and T-connectors 19, 21, 22 and 23 to assemble frame 11 to have a depth of four inches. Corner connectors and T-connectors having a two-inch depth can be used to assembly of frame 11 having a two-inch depth or other sized connectors can be used depending on the depth of the acoustic material and level of sonic absorption required. Tubing 24, 26, 27, 28, 29, 31, 32, 33, 34, 36, 44, 46, 47, 48, 49, 51, 52 and 53 are extruded square shape tube plastic cut to precise lengths which are connected together with four-way corner connectors 14, 16, 17 and 18 and six-way T-connectors 19, 21, 22 and 23. Tubing 24, 26, 27, 28, 29, 31, 32, 33, 34, 36, 44, 46, 47, 48, 49, 51, 52 and 53 can have other shapes such as round, rectangle, triangle and other multi-sided designs. Frame 11 creates a frame member that allows the user to easily insert acoustic material 12 or other material into the interior 20 of frame 11.

Frame 11 can be made to have the shape of a square, rectangle, box, triangle or other shape desired by the user. T-connectors 19, 21, 22 and 23 are adapted to accommodate, but not limited to, four-inch thick acoustic material, depending on the type of sound waves to be absorbed, such as either high and midrange or low frequencies.

Once frame 11 is assembled, it is covered with fabric slipcover 13. Fabric slipcover 13 is preferably an acoustically transparent fabric custom sewn slipcover conducive to penetrable sound waves. Fabric slipcover 13 can have a variety of colors and designs for decorative purposes and to match the user's decor. Fabric slipcover 13 also prevents insulation particles from acoustic material 12 from escaping into the air. Fabric slipcover 13 is held tight and secured in the back of frame 11 by a fastener 15, such as a drawstring, Velcro fasteners or other hook and loop fasteners, snaps, ties, hooks, zippers, magnets or other fastening methods. The sides and ends of slipcover 13 can also be sewn together to hold slipcover 13 on frame 11. Slipcover 13 easily fully covers the front, back and sides of the four-inch deep frame 11 once the device is assembled. Slipcover 13 is made of acoustically sensitive fabric that allows sound waves to penetrate into acoustic material 12, while at the same time preventing particles from acoustic material 12 from escaping into the surrounding environment. The bottom of slipcover 13 can also have a securing flap (not shown) that is attachable to slipcover 13 with Velcro fasteners, other hook and loop fasteners, draw-string ties, zippers, snaps, magnets and the like.

Figure 7:
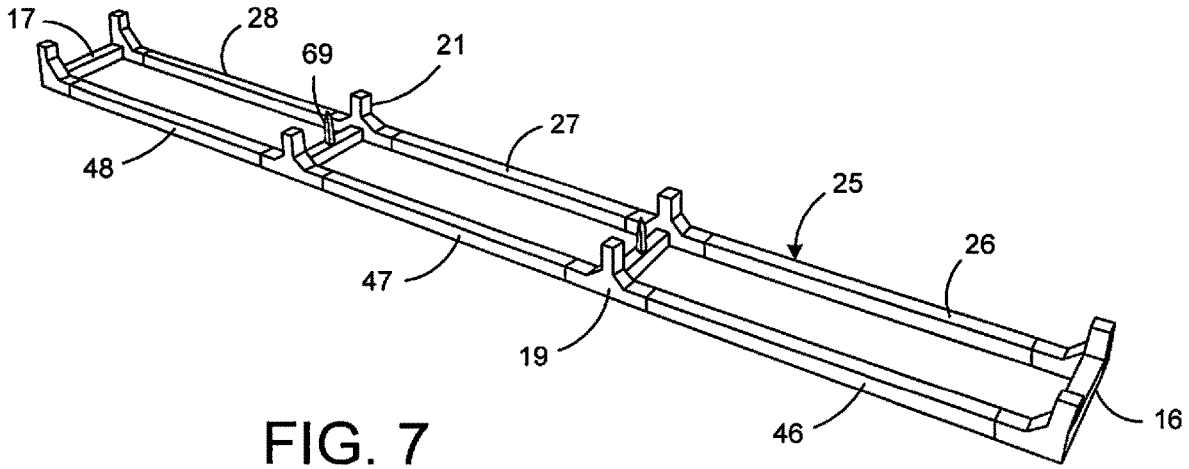
FIG. 7 is a perspective view of the cap assembly of the frame of the acoustic material frame assembly of FIG. 1.
Figure 8:
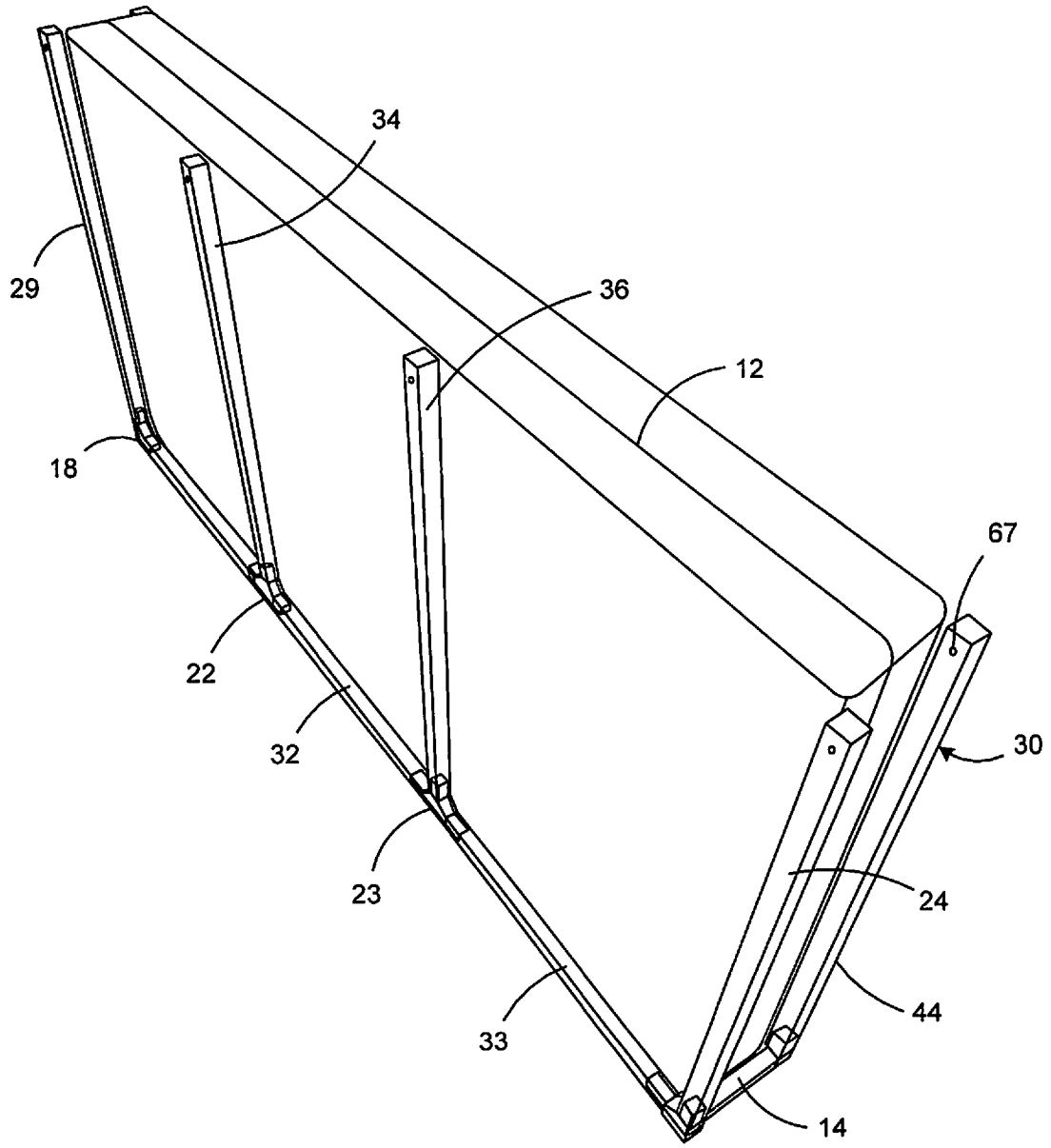
FIG. 8 is a perspective view of the secondary frame assembly and the encased acoustic material of the acoustic material frame assembly of FIG. 1.
Figure 9:
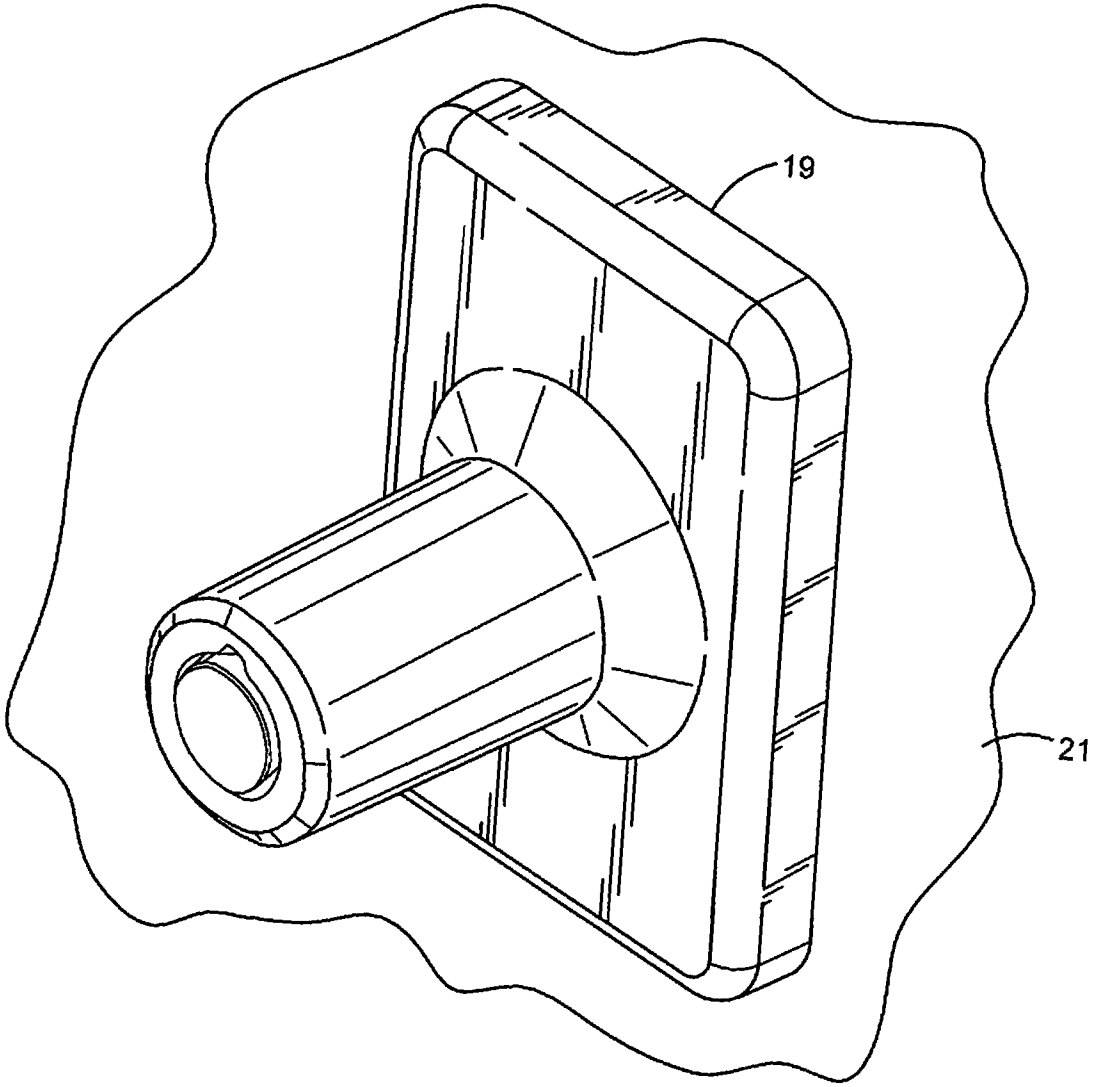
FIG. 9 is an enlarged perspective view of a standoff affixed to a mounting surface for mounting the acoustic material frame assembly to the mounting surface.

As shown in FIG. 7, standoffs 19, such as two-inch standoffs, affixed to a mounting surface 21 are used to support and allow frame assembly 10 to stand-off or float from mounting surface 21. The gap between frame assembly 10 and mounting surface 21 allows sound waves to pass through acoustic material 12, bounce off surface 21 and enter acoustic material 12 a second time substantially preventing the sound wave from re-entering the desired area. Standoffs 19 are affixed to mounting surface 21 by using Velcro fasteners or other hook and loop fasteners, snaps, magnets, slip-notches, clips or similar methods. An attaching apparatus, such as a magnet, hook and loop fastener, double-sided tape and the like can also be used to mount frame assembly 10 directly on mounting surface 21.

Corner connectors 14, 16, 17 and 18 are four-inch corner connectors adapted to accommodate the desired four-inch thick depth of the acoustic material used and four-inch T-connectors. The depth of frame 11 is determined by selecting four-inch corner connectors and T-connectors or other sized connectors, such as two-inch connectors, depending on the depth of the acoustic material and level of sonic absorption desired.

Figure 4:
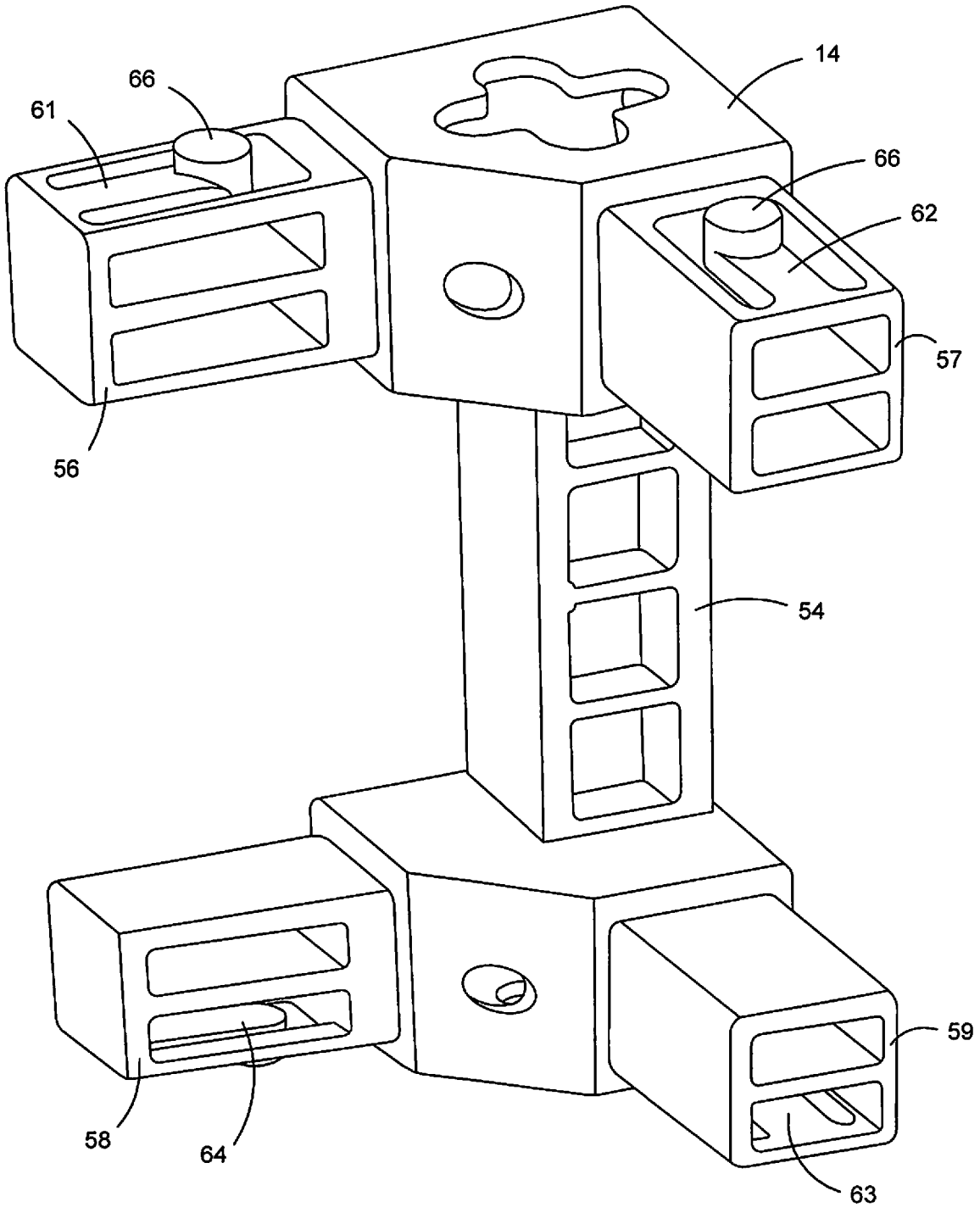
FIG. 4 is a perspective view of the corner connector of the frame of the acoustic material frame assembly of FIG. 1.

Corner connectors 14, 16, 17 and 18 are identical in structure and function. The details of corner connector 14 shown in FIG. 4 are included in corner connectors 16, 17 and 18, the following description is directed to corner connector 14.

Corner connector 14 has an upright member 54 with transverse trunks 56, 57, 58 and 59 projecting outwardly at right angles from the ends of upright member 54. Trunks 56, 57, 58 and 59 telescope and snap-fit into the ends of tubing 24, 33, 44 and 53. Trunks 56, 57, 58 and 59 are shaped complimentary to the shape of tubing 24, 33, 44 and 53, such as rectangular shaped and the like, to facilitate snap fitting. Trunks 56, 57, 58 and 59 have flexible tabs 61, 62, 63 and 64 that are adapted to flex inwardly to allow insertion of trunks 56, 57, 58 and 59 into the ends of tubing 24, 33, 44 and 53. The ends of tabs 61, 62, 63 and 64 each have an upright cylindrical shaped boss 66 that snap-fit into corresponding holes 67 in the ends of tubing 24, 33, 44 and 53.

Figure 5:
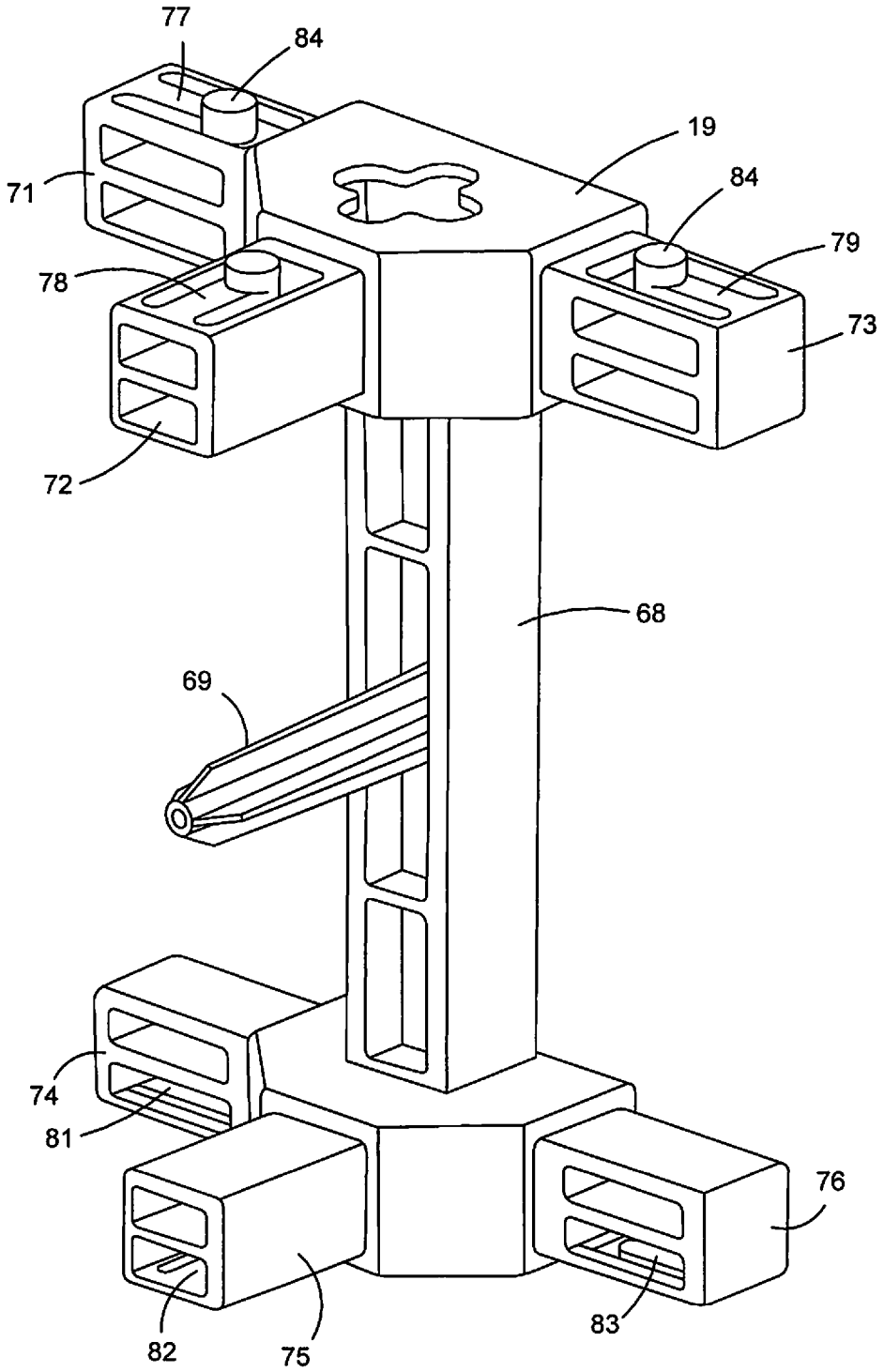
FIG. 5 is a perspective view of the T-connector of the frame of the acoustic material frame assembly of FIG. 1.
Figure 6:
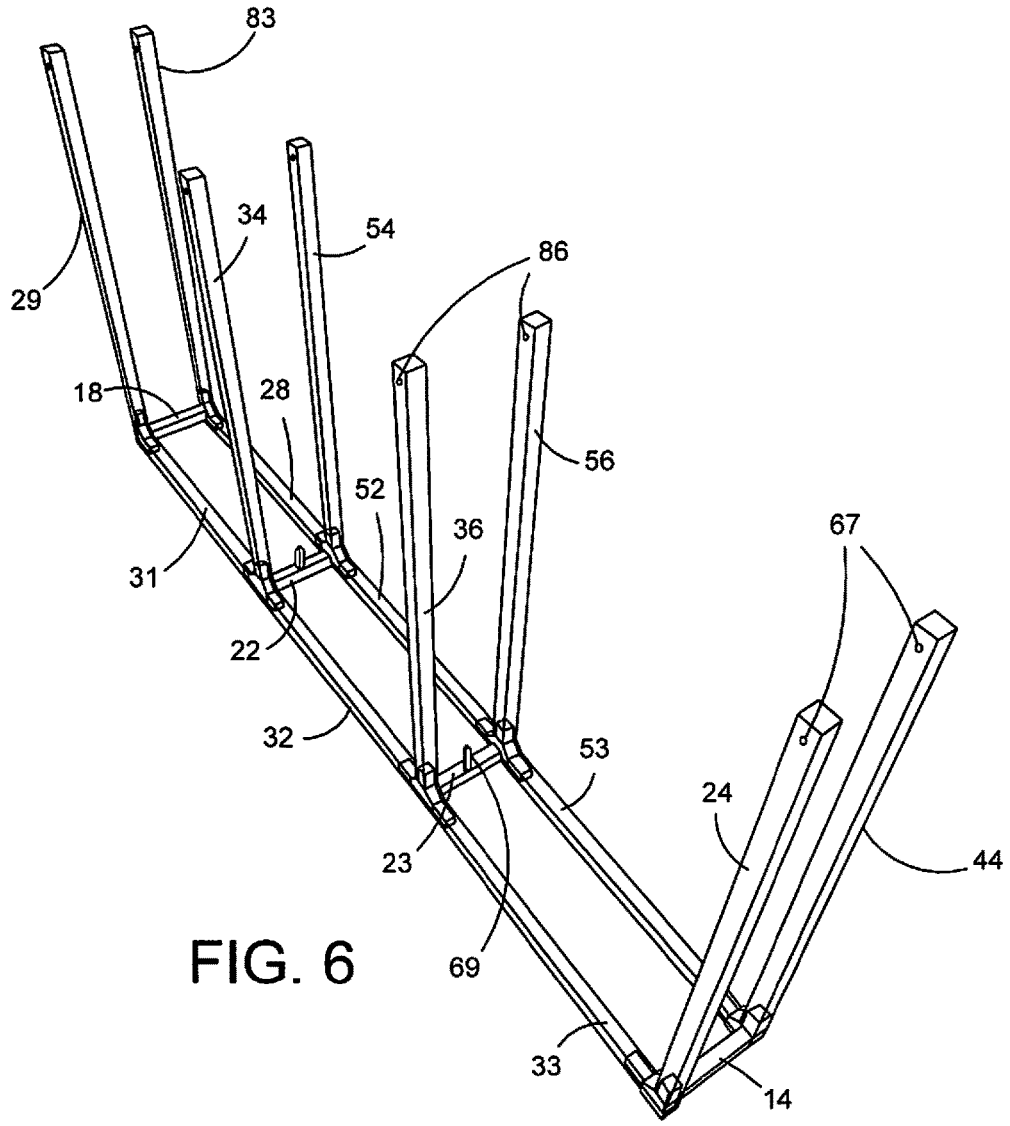
FIG. 6 is a perspective view of the secondary frame assembly of the frame of the acoustic material frame assembly of FIG. 1.

Similarly, T-connectors 19, 21, 22 and 23 are identical in structure and function. The details of T-connector 19 shown in FIG. 5 are included in T-connectors 21, 22 and 23, the following description is directed to T-connector 19.

T-connector 19 has an upright member 68 with trunks 71, 72, 73, 74, 75 and 76 projecting outwardly in opposing directions and right angles from the ends of upright member 68. Trunks 71, 72, 73, 74, 75 and 76 are adapted to telescope into the ends of tubing 26, 27, 36, 46, 47 and 56 with a snap-fit to connect tubing 26, 27, 36, 46, 47 and 56 with T-connector 19. Trunks 71, 72, 73, 74, 75 and 76 are shaped complimentary to the shape of tubing 26, 27, 36, 46, 47 and 56, such as rectangular shaped and the like, to facilitate snap fitting. T-connector 19 has flexible tabs 77, 78, 79, 81, 82 and 83 that are adapted to flex inwardly to allow insertion of trunks 71, 72, 73, 74, 75 and 76 into corresponding ends of tubing 26, 27, 36, 46, 47 and 56. The ends of tabs 77, 78, 79, 81, 82 and 83 each have an upright cylindrical shaped boss 84 that snap-fit into corresponding holes 86 in the ends of tubing 26, 27, 36, 46, 47 and 56. A transverse spike member 69 extends outwardly from upright member 68. Spike member 69 is adapted to engage and stabilize acoustic material 12 located within frame 11.

Frame assembly 10 can be mounted, suspended, hung or installed on a wall, ceiling or other surface, or let free-stand in the desired area. Frame assembly 10 is mounted to flat target surface with fasteners such as Velcro or other hook and loop fasteners, clips, magnets, double-sided tape, hooks, screws, wall anchors or other methods located on a selected area on the back of frame assembly 10 for flush and even mounting. Also mounting devices, such as standoffs 19, can be applied to mounting surface 21 or other target surfaces that frame assembly 10 connects via Velcro or other hook and loop fastener, clips, magnets, double-sided tape, wall anchors, screws or other methods. This allows for the entire frame assembly 10 to stand-off away and be spaced a fixed distance from the targeted mounting surface, thus allowing frame assembly 10 to capture additional sound waves.

The method of making frame assembly 10 includes assembling frame 11 starting with snap-fitting or otherwise flexing tabs 61, 62, 63, 64, 77, 78, 79, 81, 82 and 83 inwardly and inserting tubing 26, 27, 28, 46, 47 and 48 into the ends of corner connectors 16 and 17 and T-connectors 19 and 21 until bosses 66 and 84 snap into holes 67 and 86 to form a side cap assembly 25. The remaining tubing 24, 29, 31, 32, 33, 34, 36, 44, 49, 51, 52, 53, 54 and 56 is snap-fit into the ends of corner connectors 14 and 18 and T-connectors 22 and 23 to form a secondary frame assembly 30 in a similar manner. Acoustic material 12 is then inserted into the open end of secondary frame assembly 30 into engagement with spikes 69 of T-connectors 22 and 23. Cap assembly 25 is then snap-fit onto secondary frame assembly 30 whereby spikes 69 of T-connectors 19 and 21 engage acoustic material 12 and acoustic material 12 is compressed into the interior 20 of frame 11 thus completing the assembly of frame 11. Fabric slipcover 13 is then placed over the top of frame 11 and pulled down to enclose frame 11. Fabric slipcover 13 is pulled tight and secured in the back of frame 11 with fastener 15. The entire frame 11 with encased acoustic material 12 is covered with fitted fabric slipcover 13 which is adapted to be easily pulled over to completely cover frame 11, and secured using a drawstring, ties, zippers, hook and loop, snaps or other like fasteners. The fabric of slipcover 13 has a slight stretch character that allows slipcover 13 to easily fit over frame 11 and encased acoustic material 12. Once frame 11 and acoustic material 12 are covered, frame assembly 10 is complete and ready for installation and use.

Standoffs 19, such as four 2-inch mounting brackets, can be attached or affixed to target mounting surface 21 to ensure maximum performance of frame assembly 10. Fastening material, such as a magnet, hook and loop fastener, double-sided tape, wall anchors, screws or other fasteners, can be located on the back of acoustic frame assembly 10 to align with standoffs 19 and affixed thereto.

Frame 11 is preferably constructed and manufactured using a plastic or thermoplastic and can be sourced using recycled plastic. Corner connectors 14, 16, 17 and 18, T-connectors 19, 21, 22 and 23 and tubing 24, 26, 27, 28, 29, 31, 32, 33, 34, 36, 44, 46, 47, 48, 49, 51, 52 and 53 of frame 11 are easily manufactured in such a way as to apply industry standard equipment such as thermoplastic injection molding, CNC milling, additive 3D printing or other similar or related manufacturing equipment.

The acoustic material frame illustrated and described includes several embodiments of the invention. Variations and modifications of the acoustic material frame and acoustic frame materials can be made by a person skilled in the art without departing from the invention.

The invention claimed is:

1. An acoustic material frame assembly comprising:

a frame, the frame having first connectors and second connectors joined to the first connectors with a plurality of tubes to define a frame member, the first connectors each having a first transverse member, first trunks projecting outwardly from the first transverse member, the first trunks extending into the tubes, the first trunks each having a first tab member extending into first holes of the tubes to connect the first trunks to the tubes, the second connectors each having a second transverse member, second trunks projecting outwardly from the second transverse member, the second trunks extending into the tubes, the second trunks each having a second tab member extending into second holes of the tubes to connect the second trunks to the tubes, acoustic material located within the frame member, the acoustic material adapted to absorb sound in an environment, and a slipcover conducive to penetrable sound waves, the slipcover covering the frame member, the second transverse member having a spike member adapted to engage and stabilize the acoustic material located within the frame member.

2. The acoustic material frame assembly of claim 1 wherein:

the slipcover is an acoustically transparent fabric slipcover.

3. The acoustic material frame assembly of claim 1 wherein:

the tubes are extruded square shaped plastic tubes.

4. The acoustic material frame assembly of claim 1 wherein:

the first connectors are four-way corner connectors.

5. The acoustic material frame assembly of claim 1 wherein:

the second connectors are six-way T-connectors.

6. The acoustic material frame assembly of claim 1 wherein:

the first connectors, the second connectors and the tubes are snap-fit together.

7. The acoustic material frame assembly of claim 1 including:

standoffs affixed to a mounting surface, the standoffs engaging the frame member to maintain a fixed distance between the frame member and the mounting surface.

8. A method of enhancing acoustic absorption comprising:

providing a frame, enclosing acoustic material within the frame, compressing the acoustic material within the frame, the acoustic material adapted to absorb sound in an environment, the frame having first connectors and second connectors and a plurality of tubes extending between the first connectors and the second connectors, the frame having a secondary frame assembly the secondary frame assembly having an open side, inserting the acoustic material through the open side into the secondary frame assembly, coupling the first connectors and the second connectors and the tubes to define the frame, and covering the frame and the acoustic material encased within the frame with a slipcover, and installing the covered frame and the encased acoustic material in the environment to absorb sound in the environment.

9. The method of claim 8 including:

assembling the frame to have a depth of at least two inches and not more than four inches.

10. The method of claim 8 wherein:

the first connectors are four-way corner connectors, the four-way corner connectors having a transverse member and trunks projecting outwardly at right angles from the ends of the transverse member, the trunks adapted to telescope and snap-fit into the ends of the tubes.

11. The method of claim 8 wherein:

the second connectors are six-way T-connectors, the six-way T-connectors having a transverse member and trunks projecting outwardly in opposing directions and at right angles from the ends of the transverse member, the trunks adapted to telescope and snap-fit into the ends of the tubes.

12. The method of claim 8 wherein:

the frame has a cap assembly, connecting the cap assembly to the secondary frame assembly adjacent the open side to compress and enclose the acoustic material within the frame.

13. The method of claim 8 wherein:

the slipcover is an acoustically transparent fabric slipcover conducive to penetrable sound waves.

14. The method of claim 8 including:

preventing insulation particles from the acoustic material from escaping into the environment.

15. The method of claim 8 including:

securing the slipcover on the frame to fully cover the frame and the acoustic material within the frame.

16. The method of claim 8 including:

mounting the frame on a mounting surface, and maintaining a fixed distance between the frame and a mounting surface.

17. The method of claim 8 including:

providing the first and second connectors with trunks having flexible tab members, flexing the tab members to snap-fit the tab members into holes in ends of the tubes to snap-fit the first and second connectors to the tubes.

* * * * *